US008295130B2

(12) United States Patent
Claessens

(10) Patent No.: US 8,295,130 B2
(45) Date of Patent: Oct. 23, 2012

(54) CHILD'S CLOCK INDICATOR

(76) Inventor: Vincent Claessens, Villars-sur-Yens (CH)

( * ) Notice: Subject to any disclaimer, the term of this patent is extended or adjusted under 35 U.S.C. 154(b) by 321 days.

(21) Appl. No.: 10/493,016

(22) PCT Filed: Dec. 20, 2001

(86) PCT No.: PCT/CH01/00736

§ 371 (c)(1),
(2), (4) Date: Dec. 3, 2004

(87) PCT Pub. No.: WO02/052357

PCT Pub. Date: Jul. 4, 2002

(65) Prior Publication Data

US 2005/0117458 A1 Jun. 2, 2005

(51) Int. Cl.

| | |
|---|---|
| ***G04B 23/02*** | (2006.01) |
| ***G04B 19/00*** | (2006.01) |
| ***G04C 23/00*** | (2006.01) |
| ***G04C 21/16*** | (2006.01) |

(52) U.S. Cl. ..... 368/73; 368/223; 368/256

(58) Field of Classification Search ..... 368/10, 368/76, 71–74, 77, 80, 89, 223, 228, 28, 368/29, 107–109, 243, 24, 256; 434/304
See application file for complete search history.

(56) References Cited

U.S. PATENT DOCUMENTS

| | | | | |
|---|---|---|---|---|
| 2,305,283 | A * | 12/1942 | Theilkas | 368/44 |
| 5,044,961 | A * | 9/1991 | Bruskewitz | 434/304 |
| 5,422,864 | A * | 6/1995 | Lorello | 368/223 |
| 5,872,746 | A * | 2/1999 | Reiner et al. | 368/223 |
| 6,071,124 | A * | 6/2000 | Ang et al. | 434/304 |
| 6,361,325 | B1 * | 3/2002 | McGuire | 434/304 |
| 6,392,963 | B1 * | 5/2002 | McGinnis-Smith et al. | 368/107 |
| 6,416,216 | B1 * | 7/2002 | Haughey | 368/89 |
| 6,614,727 | B2 * | 9/2003 | McGuire | 368/223 |

FOREIGN PATENT DOCUMENTS

| | | | |
|---|---|---|---|
| GB | 2259160 A | | 3/1993 |
| WO | WO 87/00309 | * | 1/1987 |

* cited by examiner

*Primary Examiner* — Vit W Miska
(74) *Attorney, Agent, or Firm* — Marguerite Del Valle

(57) ABSTRACT

The invention concerns a child's clock indicator (1) comprising a housing (6) and a dial (7). Time-switch or timepiece elements are mounted in the housing (6) and are connected to a time adjusting indicator (4) which is adjustable with adjusting knobs (5, 8). Waking (2) or sleep (3) designs are activated in waking position or sleep position by the time-switch or timepiece elements and based on the adjustment of the time adjusting indicator.

5 Claims, 2 Drawing Sheets

CHILD'S CLOCK INDICATOR

This invention concerns a child's clock indicator and, more specifically, a waking indicator showing, based on the time, designs or images in different positions or different colors.

It is known that young children do not know how to read the time on an analog or digital clock. Even if they were capable of doing so, it would be irrelevant because they do not have a concept of time. Often, outside noises—such as cars, airplanes, singing birds—or the first rays of sunlight lead the child to believe that it is time to wake up even though it is not the case.

This situation poses numerous problems for children and parents: to children who, when they wake up, do not know whether or not it is already time to get up; and to parents who are awakened by a child who gets up too early.

The fact that a child unknowingly got up too early will often make him cranky during the day. Moreover, doing so may make the child frustrated when he finds himself facing parents who are annoyed at having been woken up too early by the child. Indeed, the child finds himself in a situation where he is being blamed for something he did not do.

For the often exhausted parents, being unnecessarily awakened is also a reason for stress and may cause greater fatigue for those who are unable to fall back to sleep after having been awakened.

In the case of children, the known embodiments of alarm clocks present significant disadvantages. In fact, alarm clocks have a waking function, be it a ringing bell, vibration, or another sort of technique. These waking functions present the disadvantage of being useless and even completely undesirable for children, because they needlessly wake up the child. These known embodiments of alarm clocks present an additional significant disadvantage in that they comprise indicators that the child cannot read.

The purpose of this invention is therefore to remedy the disadvantages of the known embodiments.

The purpose is achieved through the principles of the invention as defined in claim 1.

The child's clock indicator consists of a dial that is mounted in a housing comprised of known timepiece or time-switch analog or digital elements. The dial has one or several time adjusting indicators and one or several activating knobs for changing the time. The dial has designs or images which appear in two positions: one sleep position and one waking position. The positions may be emphasized by color differences. The position showing a figure lying down indicates to the child that he must stay in bed, and the standing-up position indicates to the child that he may get up—the moment of the change being set by the parents.

The principles of the invention have the advantage of providing the child with a time indication that is easy to understand, an indication that they would not otherwise have. When they wake up, this indication lets them know if they must go back to sleep or if they may get up. In this way, the child can no longer unknowingly make a mistake. The invention's principles present the advantage of not waking the child, but on the contrary, encouraging him to sleep as long as possible. The designs may be ones the child knows—for example, a comic strip or an animal—which will motivate the child to imitate something that he can consider a friend.

With the principles of the invention, sleep time—very important for young children—is increased significantly.

The parents are not needlessly disturbed as much in the morning or during naps, which also increases the number of hours they sleep.

There is an interaction of advantages for the parents and children, since parents who are too often awakened may become irritable, which irritation may affect the child, the principles of the invention making it possible to prevent these interactions.

The principles of the invention are shown schematically and as examples in the attached figures.

Figure 1:
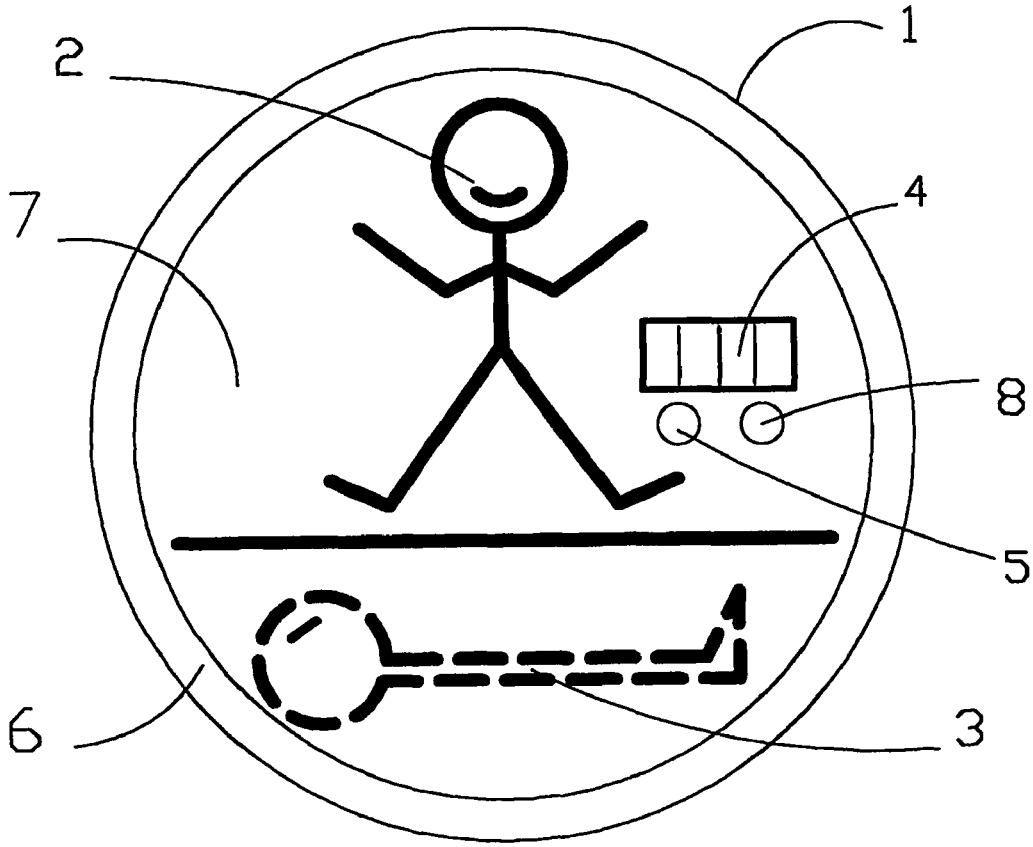
FIG. 1 shows a front view of the embodiment of a clock indicator.
Figure 2:
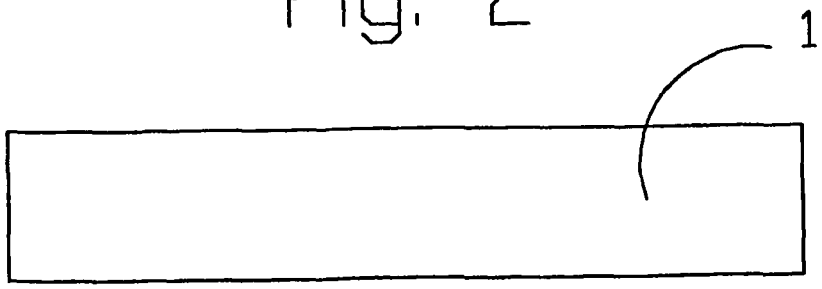
FIG. 2 shows a side view of the embodiment of a clock indicator.

Referring to FIGS. 1 and 2, a clock indicator 1 comprises a housing 6 in which a dial 7 is mounted. Time-switch or timepiece elements are mounted in the housing. The dial 7 has waking designs 2 and sleep designs 3 and a time adjusting indicator 4. The time adjusting indicator is operated by knobs 5 and 8, for example.

The dial 7 may incorporate a plate with openings which display the desired design shapes, for example designs featuring the child's hero, and a time adjusting indicator, luminous elements being located behind the openings.

The dial may also be made up of liquid crystal elements, for example.

The clock indicator may have several time adjusting indicators and several knobs.

The waking designs 2 and sleep designs 3 may show different shapes and different positions as well as different colors. The designs are also interchangeable.

FIG. 1 shows a sleep design 3 in a lying-down position and a waking design 2 in a standing-up position. In addition to the different positions, the designs may be differentiated by colors, the sleep design showing a red light and the waking design a green color, for example.

In practice, the parents set the time adjusting indicator to the time they want the time indicator to change from the sleep phase to the waking phase. At the desired time, the sleep design 3 goes off and the waking design 2 lights up. At a glance, the child knows immediately which phase he is in.

As mentioned above, the sleep designs and the waking designs are shown in FIG. 1, in lying-down and standing-up positions, respectively, which are the two most representative positions.

Nonetheless, it is possible to consider displaying other positions.

Figure 3:
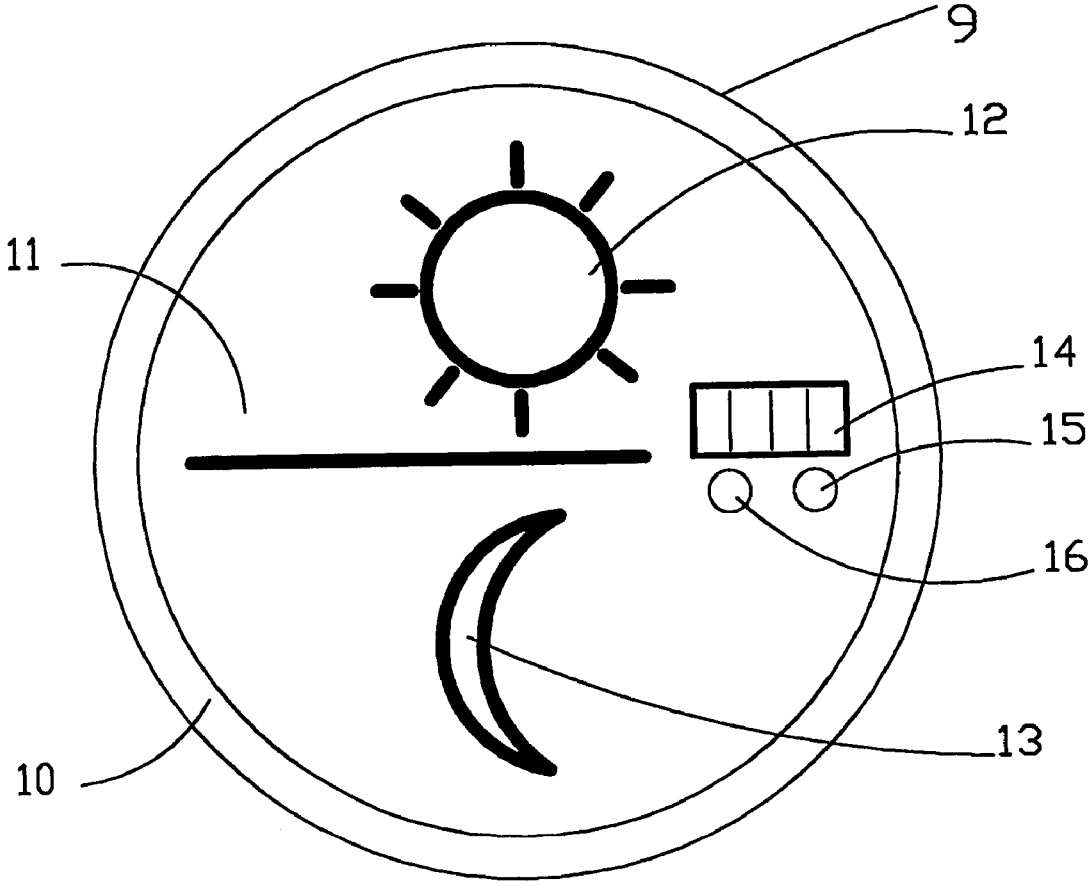
FIG. 3 shows a front view of another embodiment of a clock indicator.

FIG. 3 shows another embodiment of the adjustment indicator 9 comprising a housing 10, a dial 11, a time indicator 14, and adjustment knobs 15 and 16. In this embodiment, a sun 12 is the waking design and a moon 13 is the sleep design.

As mentioned, the clock indicator may have two adjustment knobs and two time adjusting indicators, or more if necessary. For the young child who does not sleep only at night, it may indeed be necessary to provide for an additional time adjusting indicator for naps, for example.

The waking indicator is shown as a round shape on FIGS. 1 and 3, as an example. The housing may be produced in very diverse shapes and materials.

The clock indicator may be produced so that it can be hung and also so that it may be placed on a night table, for example.

The invention claimed is:

1. Child's clock indicator comprising:

a housing containing time-switch or timepiece elements;

a window displaying a stationary screen having two designs formed thereon, a first design representing a waking position and a second design representing a sleeping position;

a first set of light elements associated with the first design and a second set of light elements associated with the second design;

timing adjustment controls which allow setting a light elements switching time;

wherein the child's clock indicator further comprises at least one switching element configured to switch on the first set of light elements and to switch off the second set of light elements indicating to a child that he may get up, said at least one switching element being further configured to switch off the first set of light elements and to switch on the second set of light elements indicating to a child that he must stay in bed;

wherein the timing adjustment control allows to set a first time at which said first set of light elements is switched on and said second set of light elements is switched off, said first time corresponding to a morning waking time;

wherein the timing adjustment control allows to set at least one second time at which said first set of light elements is switched off and said second set of light elements is switched on, said at least one second time corresponding to the time of a beginning of a nap;

wherein the timing adjustment control allows to set at least one third time at which said first set of light elements is switched on and said second set of light elements is switched off, said at least one third time corresponding to the time of an end of a nap; and wherein said first time, said at least one second time and said at least one third time can all be set before the first time arrives.

2. Child's clock indicator according to claim 1, wherein the first design is a standing-up position and the second design is a lying-down position.

3. Clock indicator according to claim 1, wherein the first design is a sun shape and the second design is a moon shape.

4. Child's clock indicator according to claim 1, wherein the waking position and the sleeping position have different colors.

5. Child's clock indicator according to claim 1, wherein the screen is made from liquid crystal elements.

* * * * *